US012084804B2

(12) United States Patent
Matsumoto

(10) Patent No.: US 12,084,804 B2
(45) Date of Patent: Sep. 10, 2024

(54) CLOTHING DRYING DEVICE

(71) Applicant: KAWAJUN CO., LTD., Tokyo (JP)

(72) Inventor: Ikuya Matsumoto, Tokyo (JP)

(73) Assignee: KAWAJUN CO., LTD., Tokyo (JP)

( * ) Notice: Subject to any disclaimer, the term of this patent is extended or adjusted under 35 U.S.C. 154(b) by 442 days.

(21) Appl. No.: 17/293,565

(22) PCT Filed: Sep. 28, 2020

(86) PCT No.: PCT/JP2020/036581
§ 371 (c)(1),
(2) Date: May 13, 2021

(87) PCT Pub. No.: WO2021/070655
PCT Pub. Date: Apr. 15, 2021

(65) Prior Publication Data

US 2022/0002931 A1 Jan. 6, 2022

(30) Foreign Application Priority Data

Oct. 7, 2019 (JP) ..... 2019-184537

(51) Int. Cl.
*D06F 53/04* (2006.01)
*B65H 75/40* (2006.01)

(52) U.S. Cl.
CPC ..... *D06F 53/045* (2013.01); *B65H 75/406* (2013.01)

(58) Field of Classification Search
USPC ..... 24/716, 909; 211/119.1
See application file for complete search history.

(56) References Cited

U.S. PATENT DOCUMENTS 104,419 A * 6/1870 Buffington ..... D06F 53/04 256/42
2,132,548 A * 10/1938 Stockwell ..... B65H 75/4471 242/255

(Continued)

FOREIGN PATENT DOCUMENTS

CN 202651491 U 1/2013
CN 204561764 U 8/2015

(Continued)

OTHER PUBLICATIONS

International Search Report w/English translation dated Nov. 24, 2020, issued in counterpart International Application No. PCT/JP2020/036581 (7 pages).

(Continued)

*Primary Examiner* — William A. Rivera
(74) *Attorney, Agent, or Firm* — WHDA, LLP

(57) ABSTRACT

A clothing drying device including: a rope having a rope main body and a grip portion provided at the tip of the rope main body; a main body storing the rope so that the rope can be polled out to the outside; and a receiving member provided independently of the main body and having a receiving member main body and a hook portion protruding from the receiving member main body, wherein the hook portion has an inner surface having an arc cross section and a pair of first flat surfaces provided on both sides sandwiching the inner surface, and the rope main body can be hooked so as to straddle at least one of the pair of first flat surfaces, and the inner surface.

13 Claims, 17 Drawing Sheets

(56) References Cited

U.S. PATENT DOCUMENTS

| | | | | | |
|---|---|---|---|---|---|
| 2,233,725 | A | * | 3/1941 | Begin | D06F 57/00 248/300 |
| 2,370,520 | A | * | 2/1945 | Bondel | D06F 53/045 242/388.6 |
| 2,481,443 | A | | 9/1949 | Pawlansky | |
| 2,551,149 | A | * | 5/1951 | McCampbell | D06F 53/045 242/399 |
| 2,742,253 | A | | 4/1956 | July | |
| 2,989,267 | A | * | 6/1961 | Mehl | D06F 53/045 242/378 |
| 4,553,715 | A | * | 11/1985 | Roselli | B65H 75/406 242/395 |
| 2005/0205631 | A1 | | 9/2005 | Richter | |
| 2010/0072314 | A1 | * | 3/2010 | Sherman | D06F 53/045 24/716 |
| 2012/0193383 | A1 | | 8/2012 | Ludwig | |

FOREIGN PATENT DOCUMENTS

| | | | |
|---|---|---|---|
| GB | 2 163 128 | * | 2/1986 |
| JP | S50-42027 | U | 11/1975 |
| JP | 59-105495 | U | 7/1984 |
| JP | S59-160091 | U | 10/1984 |
| JP | 1063789 | S | 3/2000 |
| JP | 3113640 | U | 9/2005 |
| JP | 4741450 | B2 | 8/2011 |

OTHER PUBLICATIONS

Written Opinion dated Nov. 24, 2020, issued in counterpart International Application No. PCT/JP2020/036581 (3 pages).
Office Action dated Sep. 19, 2023, issued in counterpart JP application No. 2019-184537, with English translation. (7 pages).
Office Action dated Jan. 22, 2024, issued in counterpart CN Application No. 202010005717.0, with English translation. (15 pages).

* cited by examiner

CLOTHING DRYING DEVICE

TECHNICAL FIELD

The present invention relates to a clothing drying device capable of hanging laundry, etc. indoors.

BACKGROUND ART

An indoor clothing drying tool capable of pulling out a rope for hooking laundry is disclosed. This indoor clothing drying tool hangs a rope between opposing walls in a room, and laundry can be hung on this rope. The indoor clothing drying tool includes a drum with a rope wound around, a tip locking portion provided at the tip of the rope, and a socket the tip locking member is hooked on. The socket is fixed to a wall surface B different from the wall surface A the drum is fixed to. The rope is stretched between the wall surface A and the wall surface B.

CITATION LIST

Patent Literature

[Patent Literature 1] Japanese Patent No. 4741450

DISCLOSURE OF INVENTION

Technical Problem

The tip locking member can be directly locked to the socket, but after changing the direction of the rope using a general hook or the like other than the socket, the tip locking member can be hooked on the socket installed on the wall surface different from the wall surface the hook portion is provided on. In such a case, the rope may be greatly bent at the position where the direction is changed with the hook or the like, or a large tension may be applied to a part of the rope at the bent position. When such use is repeated, bending is repeatedly applied to the same part of the rope, or a large tension is repeatedly applied to one part of the rope, as a result, the rope is damaged. In the worst case, the rope may break.

Therefore, an object of the present invention is to provide a clothing drying device that prevents the rope from being repeatedly bent or the like.

Solution to Problem

The above object is solved by the following present invention. That is, a clothing drying device of the present invention (1) comprises:

- a rope comprising a rope main body and a grip portion provided at the tip of the rope main body,
- a main body storing the rope, the rope being capable of pulling out to the outside, and
- a receiving member provided independently of the main body and comprising a receiving member main body and a hook portion protruding from the receiving member main body, wherein
- the hook portion comprising an inner surface having an arc cross section and a pair of first flat surfaces provided on both sides sandwiching the inner surface, and the rope main body configured to be capable of hooking so as to straddle at least one of the pair of first flat surfaces, and the inner surface.

Further, a clothing drying device of the present invention (2) is the clothing drying device according to (1), wherein the receiving member main body comprises a top surface provided on the hook portion side and comprising an arc cross section, and a pair of second flat surfaces provided on both sides sandwiching the top surface, and the rope main body configured to be capable of hooking so as to straddle at least one of the pair of second flat surfaces, and the top surface.

Further, a clothing drying device of the present invention (3) is the clothing drying device according to (2), wherein

- the hook portion comprises a flat first outer surface adjacent to the pair of first flat surfaces,
- the receiving member main body comprises a flat second outer surface adjacent to the pair of second flat surfaces, and
- the first outer surface is flush with the second outer surface.

Further, a clothing drying device of the present invention (4) is the clothing drying device according to any one of (1) to (3), wherein the hook portion has a protruding portion protruding closer to a wall surface to which the receiving member is fixed than the inner surface.

Further, a clothing drying device of the present invention (5) is the clothing drying device according to any one of (1) to (4) comprising a groove portion comprising a width larger than the diameter of the rope main body and smaller than the diameter of the grip portion and penetrating the hook portion in the direction intersecting with the wall surface to which the receiving member is fixed.

Further, a clothing drying device of the present invention (6) is the clothing drying device according to (5), wherein the hook portion comprises a concave portion provided at the position adjacent to the groove portion of the inner surface and recessed in a shape complementary to a part of the grip portion.

Further, a clothing drying device of the present invention (7) is the clothing drying device according to (5) or (6), wherein the inner diameter of the groove portion increases as the distance from the wall surface to which the receiving member is fixed increases.

Further, a clothing drying device of the present invention (8) is the clothing drying device according to (7), wherein the hook portion comprises pole portions provided on both sides sandwiching the groove portion, and the cross-sectional shape of the surface defining the groove portion between the pole portions is an arc shape.

Further, a clothing drying device of the present invention (9) is the clothing drying device according to (7) or (8), wherein the hook portion has a groove bottom portion defining the bottom of the groove portion, and the cross-sectional shape of the surface defining the groove portion of the groove bottom portion is an arc shape.

Further, a clothing drying device of the present invention (10) is the clothing drying device according to (9), wherein the groove bottom portion is arched so as to be convex in the direction away from the central portion of the groove portion.

Further, a clothing drying device of the present invention (11) comprises:

- a rope comprising a rope main body and a grip portion provided at the tip of the rope main body,
- a main body storing the rope, the rope being capable of polling out to the outside, and
- a receiving member provided independently of the main body and comprising a receiving member main body and a hook portion protruding from the receiving member main body, wherein the hook portion comprises a round bar shape extending along the wall surface to which the receiving member is fixed, and the rope main body configured to be capable of hooking around the hook portion, the receiving member main body comprises a top surface provided on the hook portion side and comprising an arc cross section, and a pair of flat surfaces provided on both sides sandwiching the top surface, and the rope main body configured to be capable of hooking so as to straddle at least one of the pair of flat surfaces, and the top surface.

Further, a clothing drying device of the present invention (12) is the clothing drying device according to (11) comprising a groove portion having a width larger than the diameter of the rope main body and smaller than the diameter of the grip portion and penetrating the hook portion in the direction intersecting with the wall surface to which the receiving member is fixed.

Effects of the Invention

According to the present invention, a clothing drying device that prevents the rope from being repeatedly bent or the like can be provided.

DESCRIPTION OF EMBODIMENTS

The main body of the clothing drying device of the present invention can pull out a rope from the inside and is fixed to a wall surface in a living room or the like, and used. Further, the clothing drying device has a receiving member fixed to a wall surface (second wall surface) different from the aforesaid wall surface, and a rope can be stretched between the main body and the receiving member. The user can hook the laundry or the like on the rope and dry the laundry or the like indoors.

Hereinafter, a first embodiment of a clothing drying device 11 of the present invention will be described with reference to FIG. 1 to FIG. 12.

Figure 1:
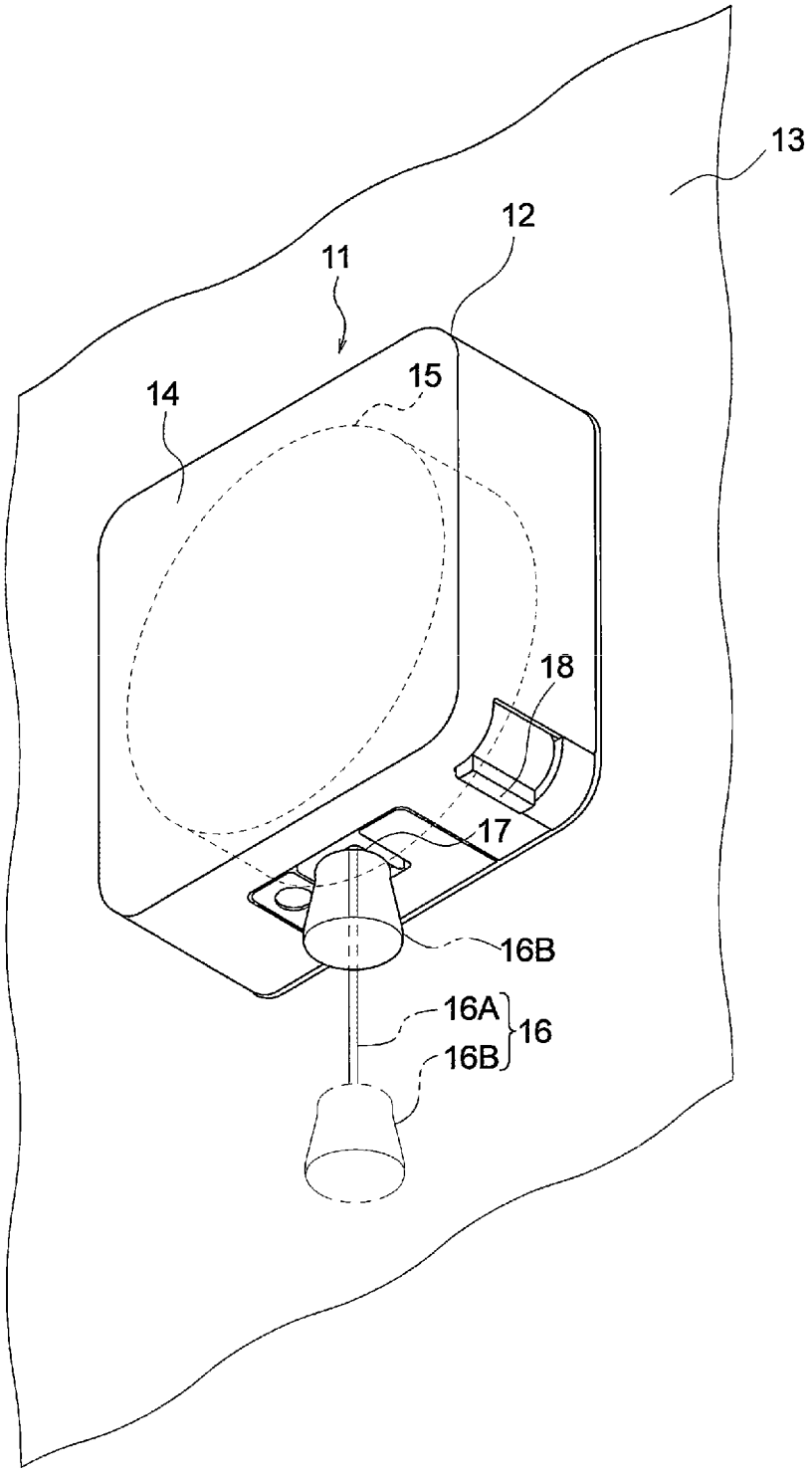
FIG. 1 is a perspective view of a main body of a clothing drying device of a first embodiment as seen from the front.
Figure 2:
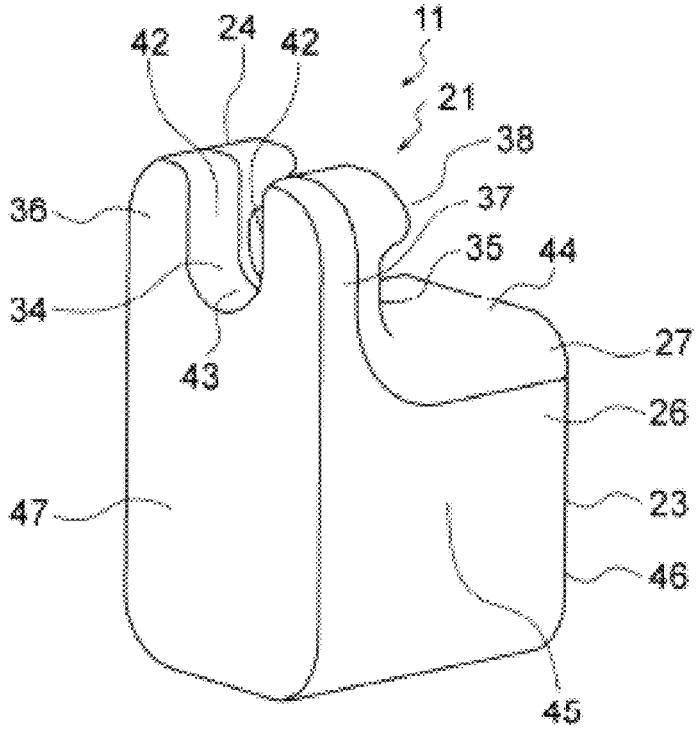
FIG. 2 is a perspective view of a first receiving member of the clothing drying device of the first embodiment as seen from the front.

As shown in FIG. 1 and FIG. 2, the clothing drying device 11 has a main body 12, and a first receiving member 21 provided independently of the main body 12. The main body 12 is fixed to a first wall surface 13 in a room. The main body 12 has a box-shaped casing body 14, a cylindrical drum 15 rotatably stored inside the casing body 14, and a rope 16 wound around the drum 15. The rope 16 can be pulled out to the outside of the casing body 14 through an outlet 17 provided on the casing body 14, and used. The peripheral part defining the outlet 17 is formed in an arc cross section so that the rope 16 does not bend extremely at the position of the outlet 17.

The drum 15 can wind the rope 16 around the outer periphery of the drum 15 by driving an incorporated spiral spring, thereby the rope 16 pulled out of the casing body 14 can be collected in the casing body 14. The clothing drying device 11 has a stopper portion (not shown) engaging with the drum 15 so as to prevent the drum 15 from rewinding while the rope 16 is pulled out, and a disengaging portion 18 for disengaging the engagement state of the stopper portion and the drum 15. The rope 16 has a rope main body 16A, and a grip portion 16B provided at the tip of the rope main body 16A. The diameter of the rope main body 16A is preferably 0.3 to 3.0 mm, for example.

Figure 6:
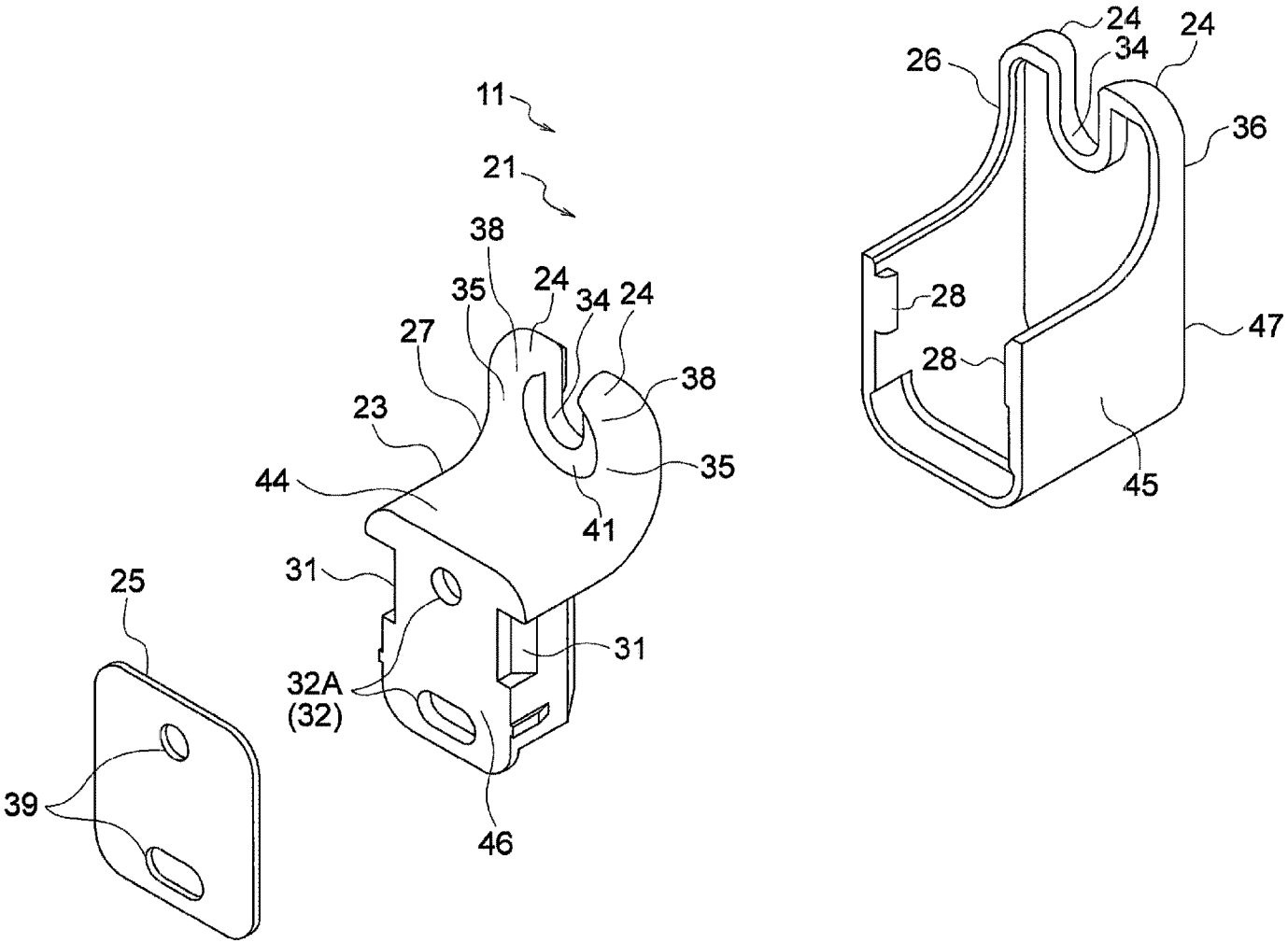
FIG. 6 is a disassembled perspective view of the first receiving member of FIG. 2 disassembled as seen from the rear.
Figure 9:
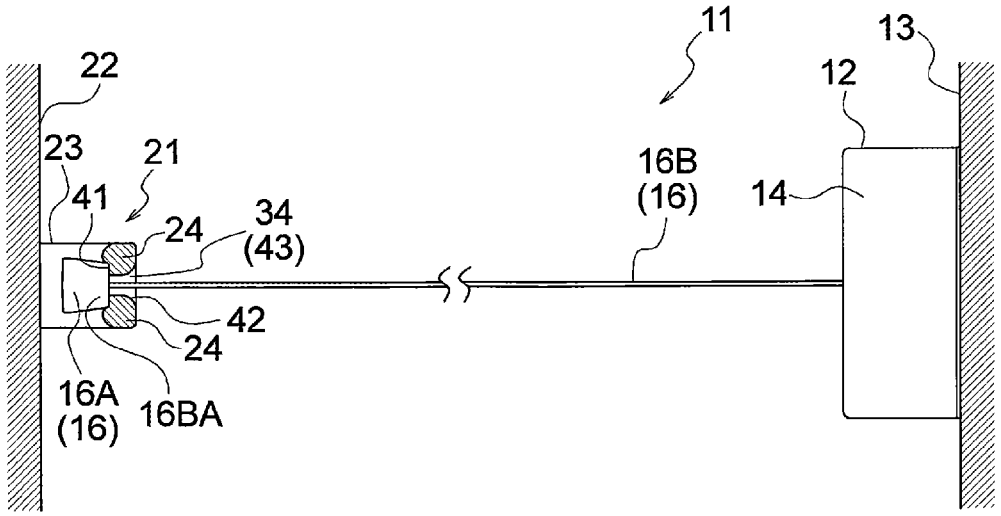
FIG. 9 is a top view showing a first aspect of the positional relationship between the clothing drying device main body of FIG. 1 and the first receiving member of FIG. 2.

As shown in FIG. 9, the first receiving member 21 is fixed to, for example, a second wall surface 22 different from the first wall surface 13, but may be fixed to the first wall surface 13 depending on usage aspects. As shown in FIG. 2, the first receiving member 21 has a substantially square block-shaped first receiving member main body 23, a first hook portion 24 protruding from the first receiving member main body 23, and a flat plate-shaped packing 25 (see FIG. 6) interposed between the first receiving member main body 23 and the second wall surface 22. The first receiving member 21 is integrally formed by combining two parts made of different materials. That is, as shown in FIG. 6, the first receiving member 21 is integrally formed by combining a first part 26 made of, for example, a synthetic resin and a second part 27 made of, for example, a metal. The first part 26 is located on the outside the first receiving member 21, and the second part 27 is located on the inside the first receiving member 21. In the present embodiment, the metal second part 27 located on the inside constitutes an inner surface 35, a part of a groove portion 43, a top surface 44, a protruding portion 38, and a concave portion 41, etc., described later, which are the parts that come into contact with and rub against the rope 16. Therefore, the abrasion resistance is better than when these parts are made of resin materials. The second part 27 is composed of, for example, either a zinc die-cast or an aluminum alloy die-cast. Further, since the first part 26 located on the outside is made of a synthetic resin material, the first part 26 becomes familiar with the surrounding indoor wallpaper, etc. by forming the first part 26 in white or the like. As a result, the first receiving member 21 becomes inconspicuous.

The first part 26 has a pair of claw portions 28. The second part 27 has a pair of recessed portions 31 with which the pair of claw portions 28 are engaged, and a pair of fixing portions 32 for fixing to wall surfaces (the second wall surface 22, the first wall surface 13). Each of the pair of fixing portions 32 has a through hole 32A and a screw (not shown) passed through the through hole 32A. The first part 26 is detachably fixed to the second part 27 via the claw portions 28. One of the through holes 32A is a circular hole, and the other of the through holes 32A is formed in a shape of a slenderly elongated hole extending in the lateral direction. The packing 25 is also provided with through holes 39 having the shapes corresponding to these.

When fixing the first receiving member 21 to the wall surface (the second wall surface 22, the first wall surface 13), the second part 27 and the packing 25 are screwed to the wall surface (the second wall surface 22, the first wall surface 13). Therefore, even if the fastening position of the screw to the wall surface (the second wall surface 22, the first wall surface 13) is slightly deviated, the inclination of the second part 27 can be adjusted with the position corresponding to the slenderly elongated hole-shaped through hole 32A. That is, the user can finely adjust the inclination of the second part 27 by rotating the second part 27 around the circular through hole 32A.

Figure 3:
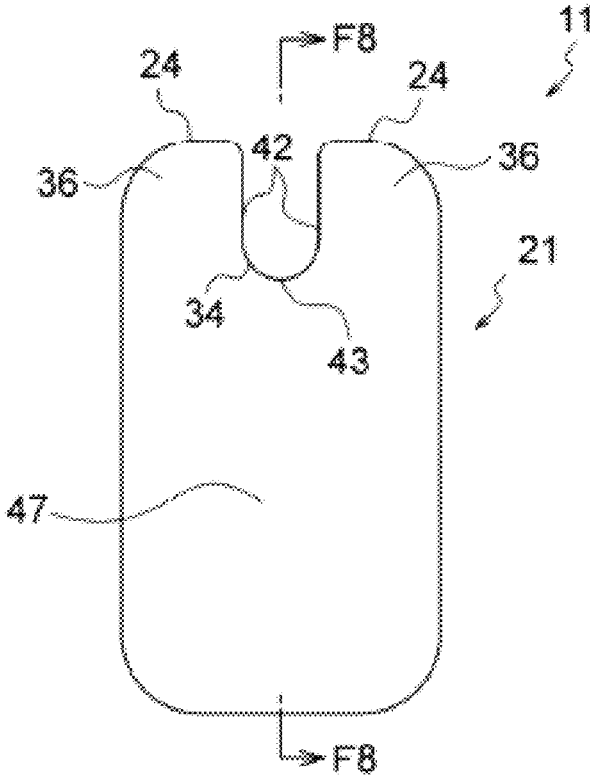
FIG. 3 is a front view of the first receiving member of FIG. 2 as seen from the front.
Figure 4:
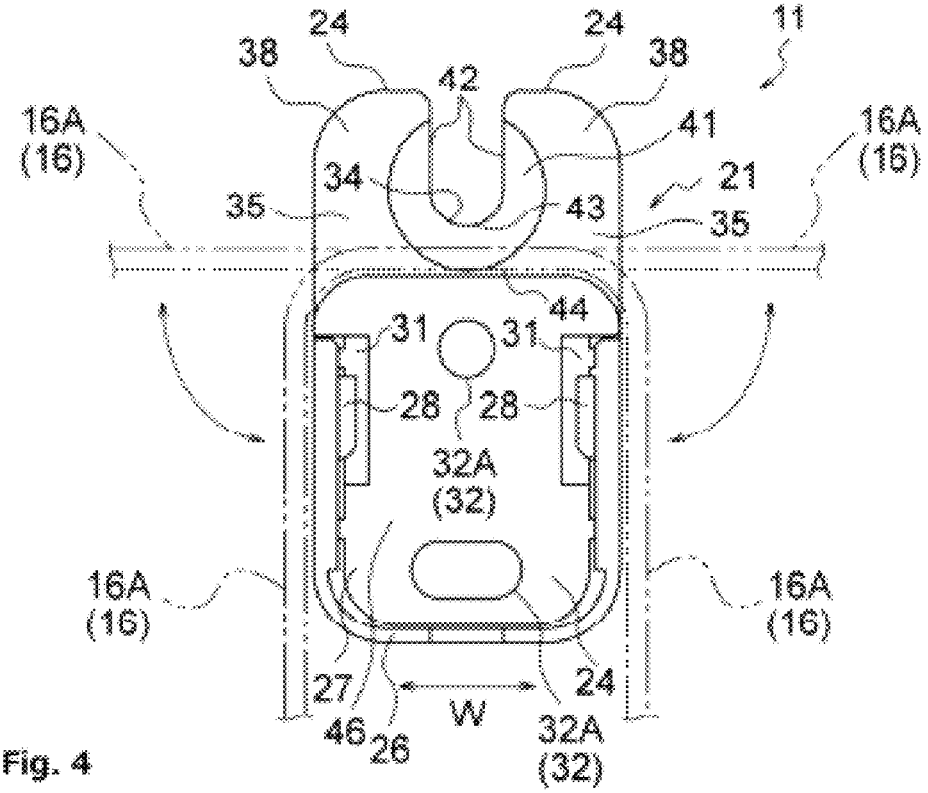
FIG. 4 is a rear view of the first receiving member of FIG. 2 as seen from the rear.
Figure 5:
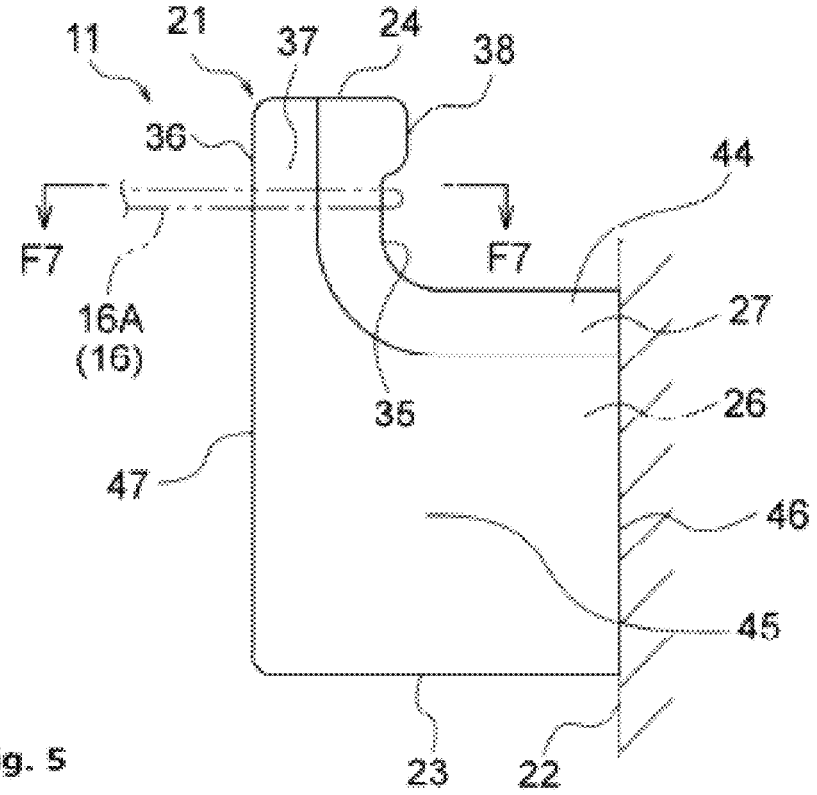
FIG. 5 is a side view of the first receiving member of FIG. 2 as seen from the side.

As shown in FIG. 2, FIG. 3, and FIG. 5, the first hook portion 24 projects from the vicinity of a second outer surface 47 of the first receiving member main body 23 in the direction along the second wall surface 22 (for example, upward). The first hook portion 24 is formed in a tip divided shape by a groove portion 34 provided on the central portion. As shown in FIG. 2 to FIG. 7, the first hook portion 24 includes: the inner surface 35; a flat first outer surface 36 provided on the opposite side of the inner surface 35; a pair of first flat surfaces 37 provided on both sides sandwiching the inner surface 35; the protruding portion 38 protruding closer to the second wall surface 22 than the inner surface 35; the groove portion 34 provided on the first hook portion 24; the concave portion 41 provided at the position adjacent to the groove portion 34 of the inner surface 35; a pair of pole portions 42 provided on both sides sandwiching the groove portion 34; and a groove bottom portion 43 defining the bottom of the groove 34.

Figure 7:
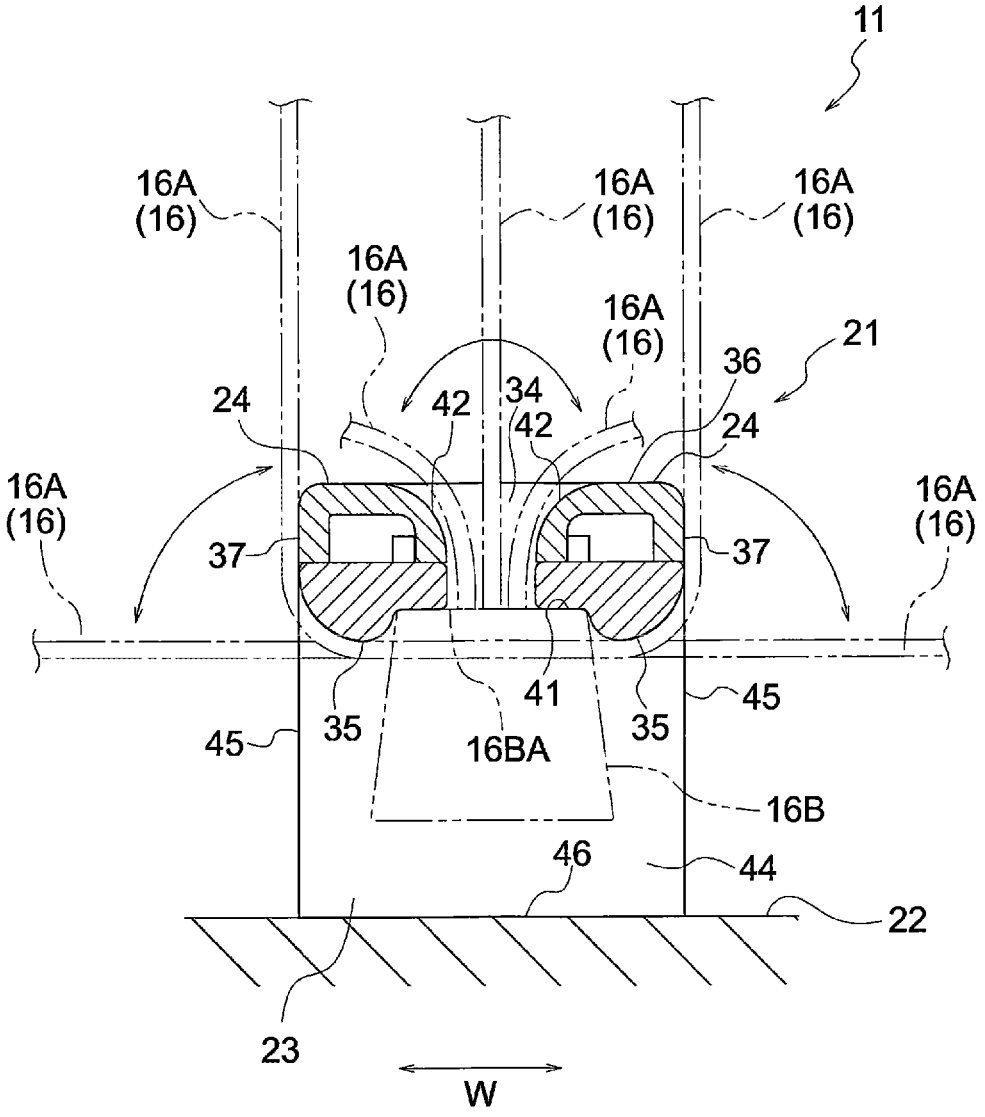
FIG. 7 is a cross-sectional view taken along a position of F7-F7 line of the first receiving member of FIG. 5.

As shown in FIG. 7, the first outer surface 36 extends along the wall surface (the second wall surface 22, the first wall surface 13) to which the first receiving member 21 is fixed. The inner surface 35 has an arc cross section as a whole, but its central portion is divided by the groove portion 34 and the concave portion 41. The radius of curvature of the inner surface 35 is, for example, preferably 3 mm or more, and more preferably 4 mm or more.

The first flat surface 37 extends in the direction intersecting with the wall surface (the second wall surface 22, the first wall surface 13) and is adjacent to the first outer surface 36. As shown in FIG. 2 and FIG. 5, the protruding portion 38 is provided at the tip of the first hook portion 24 and is provided so as to rise from the inner surface 35. The protruding portion 38 functions as a so-called barb, and can prevent the rope 16 hooked on the inner surface 35 from falling off from the first hook portion 24.

As shown in FIG. 2 and FIG. 3, the groove portion 34 is formed in a slot shape extending from the tip of the first hook portion 24 to the base position of the first hook portion 24. As shown in FIG. 7, the groove portion 34 can be paraphrased as extending so as to penetrate the first hook portion 24 in the direction intersecting with the wall surface (the second wall surface 22, the first wall surface 13). The groove portion 34 has a length larger than the diameter of the rope main body 16A and smaller than the diameter of the grip portion 16B in regard to the width direction W. The groove portion 34 is formed in a trumpet shape, and is formed so that the inner diameter increases as the distance from the second wall surface 22 increases.

The concave portion 41 is provided on the inner surface 35 and is formed so as to be recessed in a shape complementary to a part of the grip portion 16B (a head portion 16BA of the grip portion 16B). Each of the pair of pole portions 42 has a surface defining the groove portion 34. As shown in FIG. 7, the cross-sectional shape of the surface defining the groove portion 34 between the pole portions 42 is an arc shape. The radius of curvature of the pole portion 42 is, for example, preferably 3 mm or more, and more preferably 4 mm or more.

Figure 8:
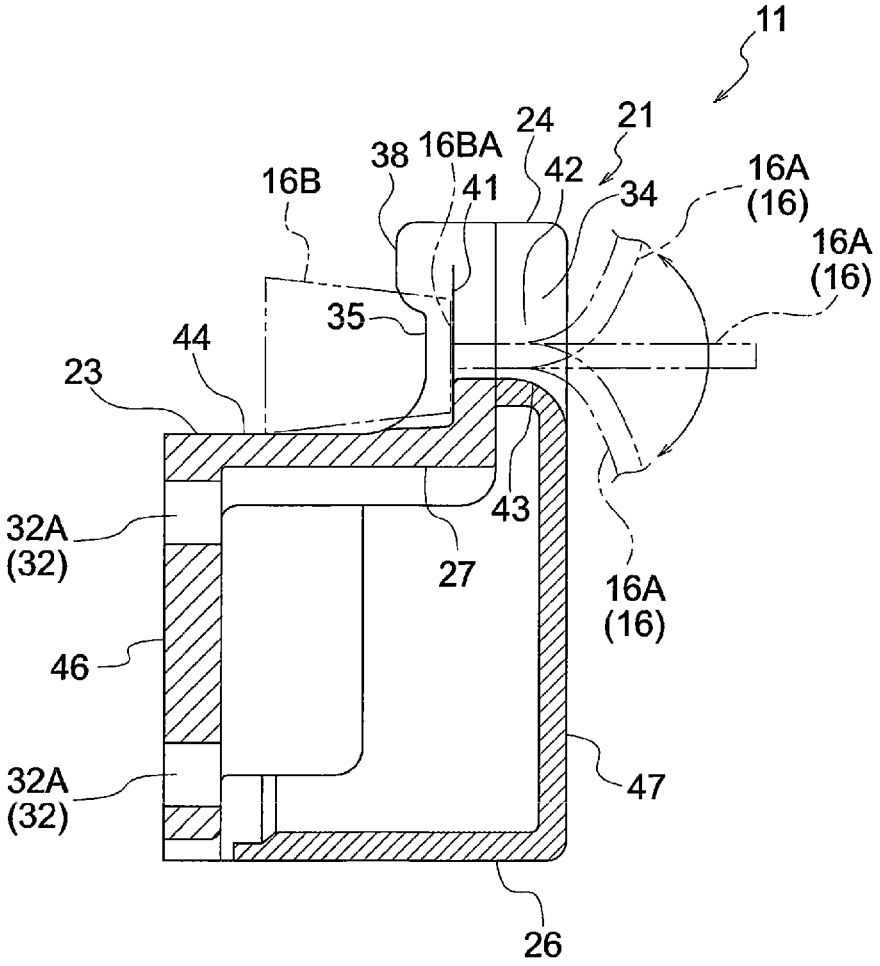
FIG. 8 is a cross-sectional view taken along a position of F8-F8 line of the first receiving member of FIG. 3.

As shown in FIG. 2 and FIG. 3, the groove bottom portion 43 is provided at the base position of the first hook portion 24. The groove bottom portion 43 has a surface defining the groove portion 34. As shown in FIG. 8, the cross-sectional shape of the surface defining the groove portion 34 of the groove bottom portion 43 is arc. The radius of curvature of the groove bottom portion 43 is, for example, preferably 3 mm or more, and more preferably 4 mm or more. As shown in FIG. 2 and FIG. 3, the groove bottom portion 43 is arched so as to become convex in the direction away from the central portion of the groove portion 34.

As shown in FIG. 2 and FIG. 4, the first receiving member main body 23 has: the top surface 44 provided on the first hook portion 24 side; a pair of second flat surfaces 45 provided on both sides sandwiching the top surface 44; a fixed surface 46 fixed to the second wall surface 22; and the flat second outer surface 47 adjacent to the pair of second flat surfaces 45. The top surface 44 has an arc cross section. In the present embodiment, the top surface 44 has a flat surface in the middle (intermediate position) of the arc cross section.

The second flat surface 45 is adjacent to the second outer surface 47. The second flat surface 45 is formed flush with the first flat surface 37. The second outer surface 47 is formed flush with the first outer surface 36.

Subsequently, the usage and action of the main body 12 and the first receiving member 21 of the clothing drying device 11 of the present embodiment will be described.

FIG. 9 shows a first aspect of the arrangement of the main body 12 and the first receiving member 21 of the clothing drying device 11. As shown in FIG. 9, in the first aspect, the user fixes the main body 12 of the clothing drying device 11 to the first wall surface 13, and fixes the first receiving member 21 of the clothing drying device 11 to the second wall surface 22 facing the first wall surface 13. The user can pull out the rope 16 from the main body 12, pass the rope main body 16A through the groove portion 34 of the first receiving member 21, and hold the head portion 16BA of the grip portion 16B with the concave portion 41. As a result, the rope 16 is fixed to the first receiving member 21. At this time, torque is applied to the drum 15 of the main body 12 in the direction of winding the rope main body 16A by the action of the spiral spring and the stopper portion, and a constant tension is applied to the rope main body 16A.

At this time, there is a difference in the installation height between the main body 12 and the first receiving member 21, and even if the first receiving member 21 is installed at the position higher than the main body 12, the rope main body 16A is gently bent and guided by the arc groove bottom portion 43 of the first hook portion 24. Therefore, it is prevented that the rope main body 16A is sharply bent at the position of the groove portion 34. In this way, the user can stretch the rope 16 between the first wall surface 13 and the second wall surface 22. The user can hook the laundry on the rope 16 stretched in this way and dry the laundry indoors.

Figure 10:
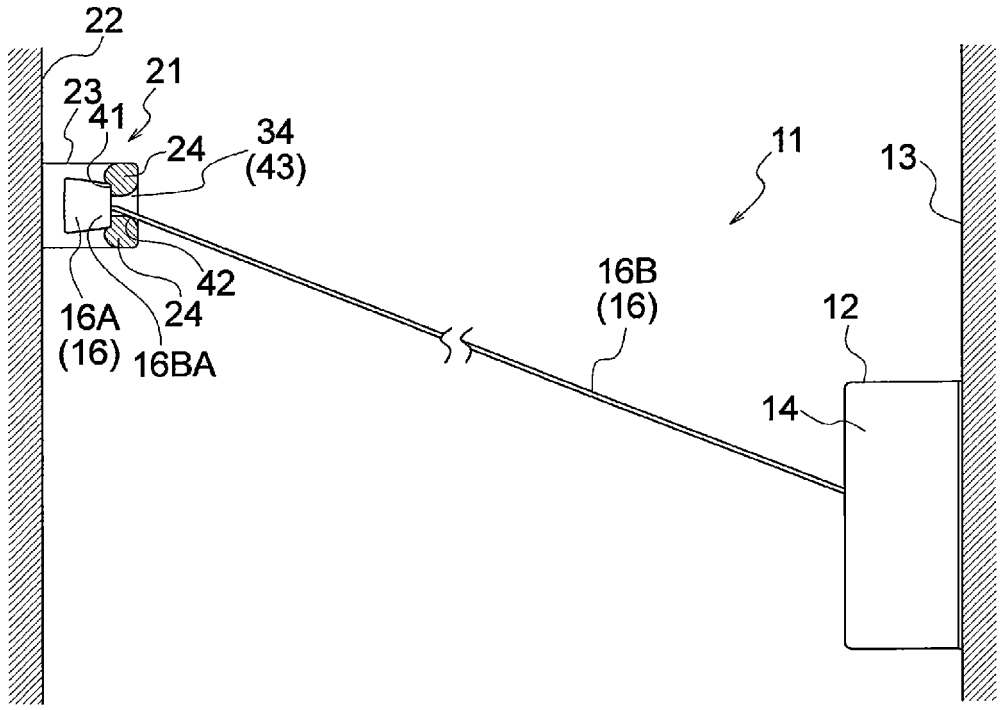
FIG. 10 is a top view showing a second aspect of the positional relationship between the clothing drying device main body of FIG. 1 and the first receiving member of FIG. 2.

FIG. 10 shows a second aspect of the arrangement of the main body 12 and the first receiving member 21 of the clothing drying device 11. In the second aspect, the user, for example, fixes the main body 12 of the clothing drying device 11 to the first wall surface 13, and fixes the first receiving member 21 of the clothing drying device 11 to the second wall surface 22 facing the first wall surface 13. At this time, the first receiving member 21 is arranged not at the position facing the main body 12 but at the position displaced laterally from the main body 12. The user can pull out the rope 16 from the main body 12, pass the rope main body 16A through the groove portion 34 of the first receiving member 21, and hold the head portion 16BA of the grip portion 16B with the concave portion 41. As a result, the rope 16 is fixed to the first receiving member 21. At this time, torque is applied to the drum 15 of the main body 12 in the direction of winding the rope main body 16A by the action of the spiral spring and the stopper portion, and a constant tension is applied to the rope main body 16A. In this way, the rope 16 can be stretched between the first wall surface 13 and the second wall surface 22.

When the grip portion 16B is hooked on the concave portion 41 of the first receiving member 21, the rope main body 16A comes into contact with the inner surface of the groove portion 34 (the pair of pole portions 42). At that time, the rope main body 16A is gently bent and guided by the pole portions 42 of the first hook portion 24. Therefore, it is prevented that the rope main body 16A is sharply bent at the position of the groove portion 34. In this way, even when the first receiving member 21 is displaced with respect to the main body 12, the rope main body 16A does not bend at the position of the groove portion 34. The user can hook the laundry on the rope 16 stretched in this way and dry the laundry indoors.

Figure 11:
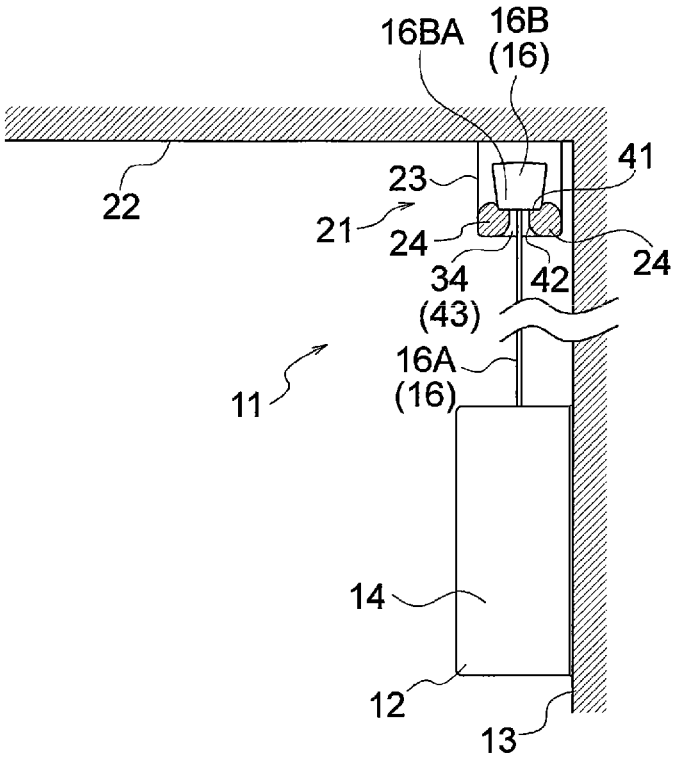
FIG. 11 is a top view showing a third aspect of the positional relationship between the clothing drying device main body of FIG. 1 and the first receiving member of FIG. 2.

FIG. 11 shows a third aspect of the arrangement of the main body 12 and the first receiving member 21 of the clothing drying device 11. In the third aspect, the user, for example, fixes the main body 12 of the clothing drying device 11 to the first wall surface 13, and fixes the first receiving member 21 of the clothing drying device 11 to the second wall surface 22 adjacent to the first wall surface 13. The user can pull out the rope 16 from the main body 12, pass the rope main body 16A through the groove portion 34 of the first receiving member 21, and hold the head portion 16BA of the grip portion 16B with the concave portion 41. As a result, the rope 16 is fixed to the first receiving member 21. At this time, torque is applied to the drum 15 of the main body 12 in the direction of winding the rope main body 16A by the action of the spiral spring and the stopper portion, and a constant tension is applied to the rope main body 16A.

At this time, there is a difference in the installation height between the main body 12 and the first receiving member 21, and even if the first receiving member 21 is installed at the position higher than the main body 12, the rope main body 16A is gently bent and guided by the groove bottom portion 43 of the first hook portion 24. Therefore, it is prevented that the rope main body 16A is sharply bent at the position of the groove portion 34. In this way, the rope 16 can be stretched between the first wall surface 13 and the second wall surface 22. The user can hook the laundry on the rope 16 stretched in this way and dry the laundry indoors.

Figure 12:
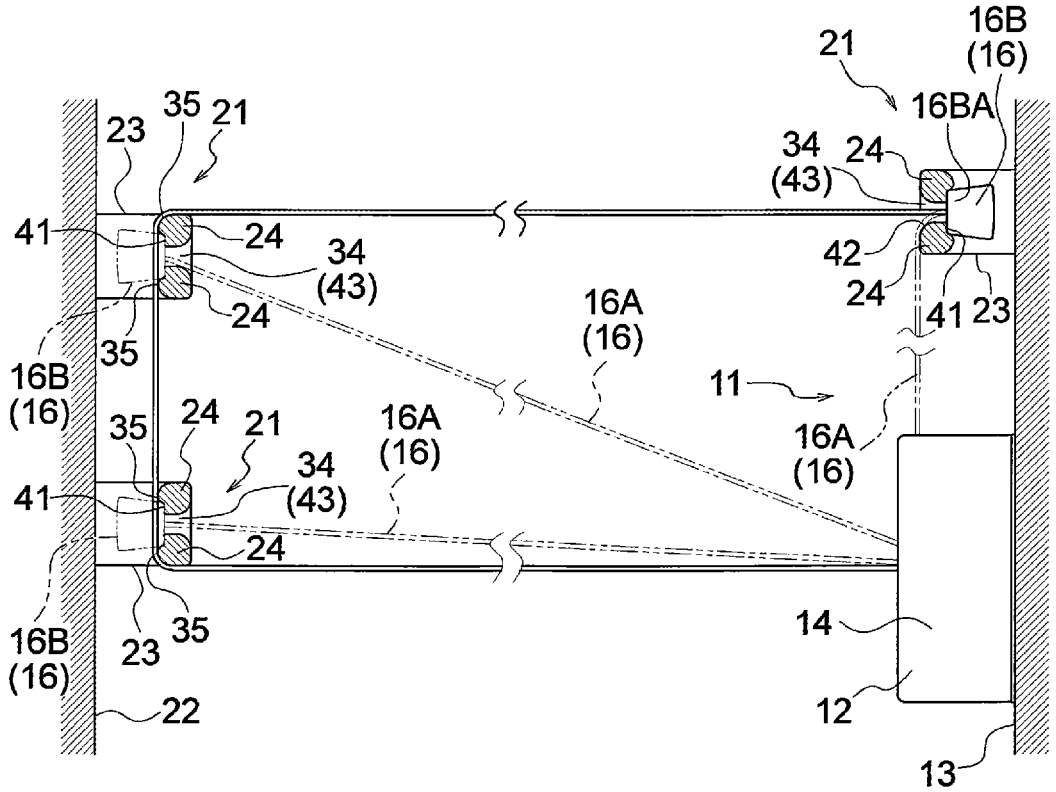
FIG. 12 is a top view showing a forth aspect of the positional relationship between the clothing drying device main body of FIG. 1 and the first receiving member of FIG. 2.
Figure 13:
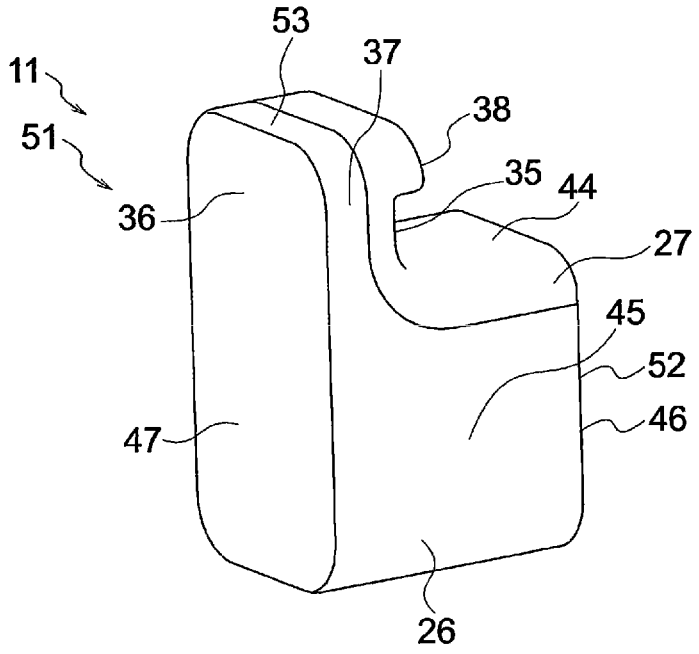
FIG. 13 is a perspective view of a second receiving member of a clothing drying device of a second embodiment as seen from the front.

FIG. 12 shows a fourth aspect of the arrangement of the main body 12 and the first receiving members 21 of the clothing drying device 11. As shown in FIG. 12, in the fourth aspect, the user, for example, fixes the main body 12 of the clothing drying device 11 to the first wall surface 13, and fixes the first receiving members 21 of the clothing drying device 11 to the first wall surface 13 and the second wall surface 22 facing the first wall surface 13. The first receiving member 21 fixed to the first wall surface 13 is fixed so as to be laterally displaced from the main body 12. The first receiving members 21 fixed to the second wall surface 22 are installed at a distance from each other. For example, one of the first receiving members 21 fixed to the second wall surface 22 is installed at the position corresponding to the main body 12, and the other of the first receiving members 21 fixed to the second wall surface 22 is installed at the position corresponding to the first receiving member 21 fixed to the first wall surface 13.

The user can hook the rope main body 16A pulled out from the main body 12 on the inner surface 35 of the first hook portion 24 of one of the first receiving members 21 of the second wall surface 22. At this time, since the inner surface 35 of the first hook portion 24 has an arc cross section, a part of the rope body 16A is not sharply bent. The user can continue to pull out the rope main body 16A from the main body 12 and hook the rope main body 16A on the inner surface 35 of the first hook portion 24 of the other first receiving member 21 of the second wall surface 22. In this case as well, since the inner surface 35 of the first hook portion 24 has an arc cross section, a part of the rope body 16A is not sharply bent.

The user further pulls out the rope main body 16A from the main body 12, passes the rope main body 16A through the groove portion 34 of the first receiving member main body 23 of the first wall surface 13, and arranges the grip portion 16B in the concave portion 41. As a result, the rope 16 is fixed to the first receiving member 21. At this time, torque is applied to the drum 15 of the main body 12 in the direction of winding the rope main body 16A by the action of the spiral spring and the stopper portion, and a constant tension is applied to the rope main body 16A. As a result, the rope 16 can be double-stretched between the first wall surface 13 and the second wall surface 22.

At that time, a large tension is applied to the rope main body 16A around one of the first receiving members 21 of the second wall surface 22 and around the other first receiving member 21 of the second wall surface 22, but since the inner surfaces 35 of the hook portions 24 of the first receiving members 21 are formed in an arc cross section, the rope body 16A is not sharply bent at those positions. Therefore, it is prevented that the rope main body 16A is damaged at these positions. The user can hook the laundry on the rope 16 double-stretched in this way and dry the laundry indoors. When the position of the first receiving member 21 of the first wall surface 13 is laterally displaced from the corresponding first receiving member 21 of the second wall surface 22, the same effect as in the above second aspect is obtained.

Further, there is a difference in the installation height between the first receiving member 21 of the first wall surface 13 and the first receiving member 21 of the second wall surface 22, and even if the first receiving member 21 of the first wall surface 13 is installed at the position higher than the first receiving member 21 of the second wall surface 22, the rope main body 16A is gently bent and guided by the groove bottom portion 43 of the first hook portion 24. Therefore, it is prevented that the rope main body 16A is sharply bent at the position of the groove portion 34.

On the contrary, there is a difference in the installation height between the first receiving member 21 of the first wall surface 13 and the first receiving member 21 of the second wall surface 22, and even if the first receiving member 21 of the second wall surface 22 is installed at the position higher than the first receiving member 21 of the first wall surface 13, the rope main body 16A is gently bent and guided by the top surface 44 of the first receiving member 21 of the second wall surface 22. Therefore, it is prevented that the rope main body 16A is sharply bent at the position of the groove portion 34. Further, as shown by the two-dot chain line in FIG. 12, the user can hook the grip portion 16B on the first receiving member 21 located on the second wall surface 22 and in front of the main body 12 to stretch the rope 16 between the first wall surface 13 and the second wall surface 22. Further, the user can hook the grip portion 16B on the first receiving member 21 located on the second wall surface 22 and diagonally in front of the main body 12 to stretch the rope 16 diagonally between the first wall surface 13 and the second wall surface 22. Further, the user can hook the grip portion 16B on the first receiving member 21 located on the first wall surface 13 to stretch the rope 16 substantially parallel to the first wall surface 13.

According to this embodiment, the followings can be said. The clothing drying device 11 includes: the rope 16 having the rope main body 16A and the grip portion 16B provided at the tip of the rope main body 16A; the main body 12 from which the rope 16 can be pulled out to the outside; and the receiving member provided independently of the main body 12 and having a receiving member main body and a hook portion protruding from the receiving member main body, and the hook portion includes the inner surface 35 having an arc cross section and the pair of first flat surfaces 37 provided on both sides sandwiching the inner surface 35, and can hook the rope main body 16A so as to straddle at least one of the pair of first flat surfaces 37 and the inner surface 35.

According to this configuration, since the inner surface 35 has an arc cross section, it is possible to prevent the rope main body 16A hooked on the hook portion from being sharply bent at that position. This makes it possible to prevent the rope main body 16A from being damaged at the position of the receiving member.

In this case, the receiving member main body has the top surface 44 provided on the hook portion side and having an arc cross section, and the pair of second flat surfaces 45 provided on both sides sandwiching the top surface 44, and can hook the rope main body 16A so as to straddle at least one of the pair of second flat surfaces 45 and the top surface 44. According to this configuration, even if the installation heights of the main body 12 and the receiving member are different, the rope main body 16A hooked on the receiving member can be gently bent and guided by the top surface 44 having the arc cross section. As a result, it is possible to prevent the rope main body 16A hooked on the receiving member from being sharply bent, and to prevent the rope main body 16A from being damaged at the position of the receiving member.

The hook portion has the flat first outer surface 36 adjacent to the pair of first flat surfaces 37, and the receiving member main body has the flat second outer surface 47 adjacent to the pair of second flat surfaces 45. The first outer surface 36 is flush with the second outer surface 47. According to this configuration, a neat appearance can be obtained by making the first outer surface 36 and the second outer surface 47 flush with each other. As a result, the receiving member does not spoil an atmosphere in a room.

The hook portion has the protruding portion 38 protruding closer to the wall surface to which the receiving member is fixed than the inner surface 35. According to this configuration, the protruding portion 38 can act as a barb, whereby the rope main body 16A hooked on the inner surface can be prevented from falling off from the hook portion.

The clothing drying device 11 has a width larger than the diameter of the rope main body 16A and smaller than the diameter of the grip portion 16B, and has the groove portion 34 penetrating the hook portion in the direction intersecting the wall surface to which the receiving member is fixed.

According to this configuration, the grip portion 16B of the rope 16 can be hooked on the hook portion. As a result, not only the rope main body 16A but also the grip portion 16B can be hooked on the hook portion, so that a receiving member which can be used for various purposes can be realized.

In this case, the hook portion has the concave portion 41 provided at the position adjacent to the groove portion 34 on the inner surface 35 and recessed in a shape complementary to a part of the grip portion 16B. According to this configuration, a part of the grip portion 16B can be engaged with the concave portion 41. As a result, the grip portion 16B can be prevented from falling off from the hook portion, and the rope 16 can be stably held with the hook portion.

In this case, the inner diameter of the groove portion 34 increases as the distance from the wall surface to which the receiving member is fixed increases. According to this configuration, the groove portion 34 can be formed in the shape expanding in a so-called trumpet shape. As a result, the rope main body 16A can be guided by the gentle curve in the groove portion 34 even when the receiving member is arranged so as to be displaced from the main body 12. As a result, the rope 16 does not bend at the position of the groove 34, and the rope 16 is not damaged at this position.

The hook portion has the pair of pole portions 42 provided on both sides sandwiching the groove portion 34, and the cross-sectional shape of each surface defining the groove portion 34 between the pair of pole portions 42 is arc. According to this configuration, even when the installation positions of the main body 12 and the receiving member main body are laterally displaced, the rope main body 16A can be guided by the pole portions 42 having an arc cross section. As a result, it is possible to prevent the rope 16 from being damaged at the position of the groove portion 34.

The hook portion has the groove bottom portion 43 that defines the bottom of the groove portion 34, and the cross-sectional shape of the surface defining the groove portion 34 of the groove bottom portion 43 is arc. According to this configuration, even if the installation positions of the main body 12 and the receiving member main body are displaced in the vertical direction (height direction, vertical direction), the rope main body 16A can be guided by the pole portions 42 having an arc cross section. As a result, it is possible to prevent the rope 16 from being damaged at the position of the groove portion 34

The groove bottom portion 43 is arched so as to become convex in the direction away from the central portion of the groove portion 34. According to this configuration, it is possible to prevent a corner portion from being formed between the pole portions 42 and the groove bottom portion 43, and to prevent the rope main body 16A from being caught at the position of this corner portion. As a result, it is possible to prevent a large tension from being applied to a part of the rope main body 16A caught on the corner portion, and to prevent the rope main body 16A from being bent at that position and damaged.

In the following second embodiment and each modification, the parts different from the first embodiment will be mainly described, and the parts common to the first embodiment will not be shown or described.

The Second Embodiment

Subsequently, a clothing drying device 11 of the second embodiment will be described with reference to FIG. 13 to FIG. 18. The clothing drying device 11 of the present embodiment uses the main body 12 and the first receiving member 21 of the first embodiment, and a second receiving member 51 described below in combination.

The second receiving member 51 has the same size as the first receiving member 21 and a shape similar to that of the first receiving member 21. However, the second receiving member 51 does not have a groove portion 34, a concave portion 41, a pole portions 42, and a groove bottom portion 43.

Figure 16:
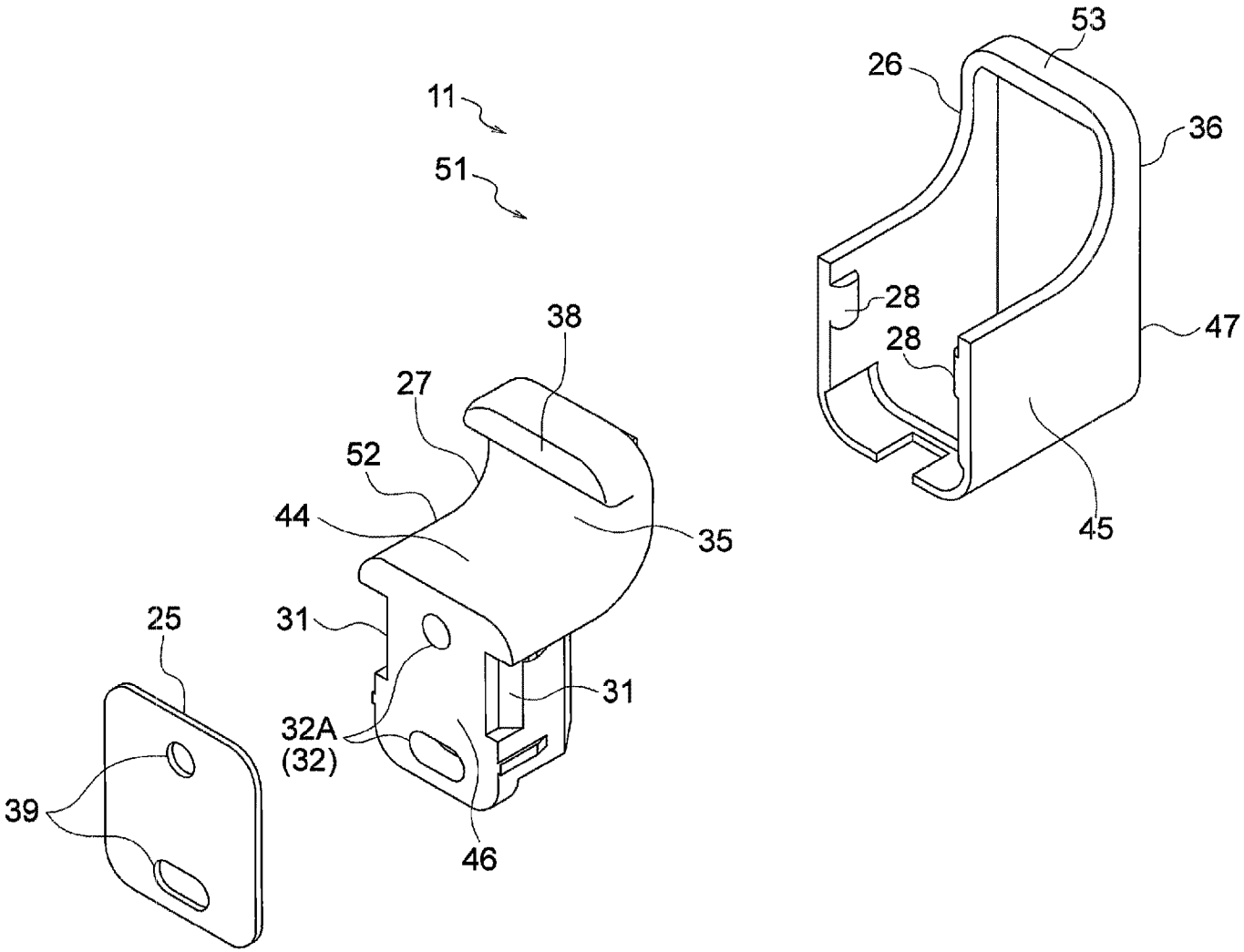
FIG. 16 is a disassembled perspective view of the second receiving member of FIG. 13 disassembled as seen from the rear.
Figure 17:
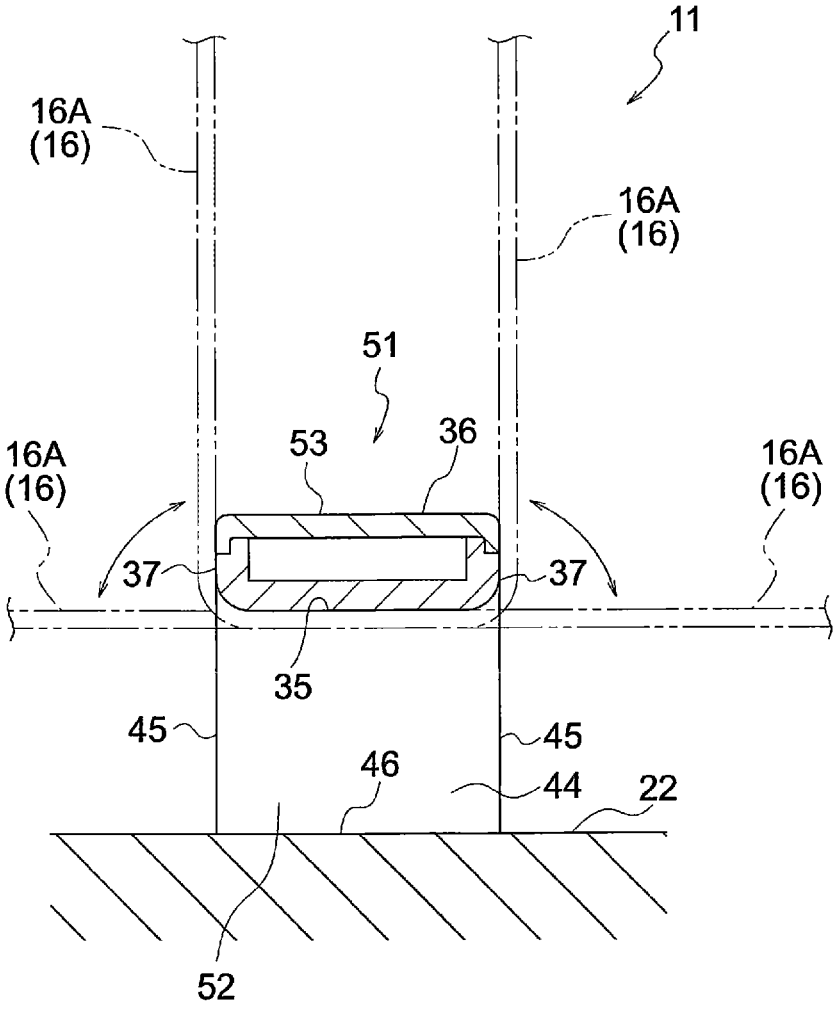
FIG. 17 is a cross-sectional view taken along a position of F17-F17 line of the second receiving member of FIG. 15.
Figure 18:
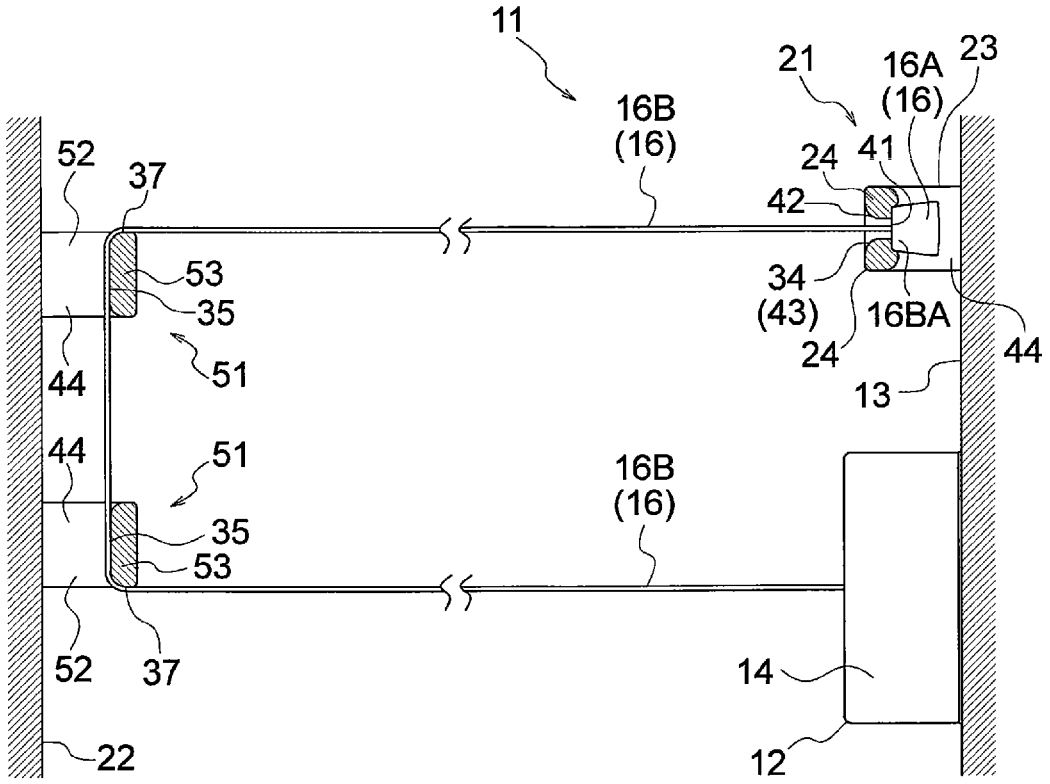
FIG. 18 is a top view showing an aspect of the positional relationship between the clothing drying device main body of FIG. 1, the first receiving member of FIG. 2, and the second receiving member of FIG. 13.

As shown in FIG. 18, the second receiving member 51 is fixed to a second wall surface 22 different from a first wall surface 13. As shown in FIG. 13 to FIG. 17, the second receiving member 51 includes: a substantially square block-shaped second receiving member main body 52; a second hook portion 53 protruding from the second receiving member main body 52; and a flat plate-shaped packing 25 interposed between the second receiving member main body 52 and the second wall surface 22. The second receiving member 51 is integrally configurated by combining two parts made of different materials. That is, as shown in FIG. 16, the second receiving member 51 is integrally configurated by combining a first part 26 made of a resin and the second part 27 made of a metal, similarly to the first receiving member 21.

The first part 26 has a pair of claw portions 28. The second part 27 has a pair of recessed portions 31 with which the pair of claw portions 28 are engaged, and a pair of fixing portions 32 for fixing to the second wall surface 22. Each of the pair of fixing portions 32 has a through hole 32A and a screw passed through the through hole 32A (not shown). The first part 26 is detachably fixed to the second part 27 via the claw portions 28. One of the through holes 32A is a circular hole, and the other of the through holes 32A is formed in a shape of a slenderly elongated hole extending in the lateral direction. The action of the through holes 32A is the same as that of the first embodiment.

Figure 14:
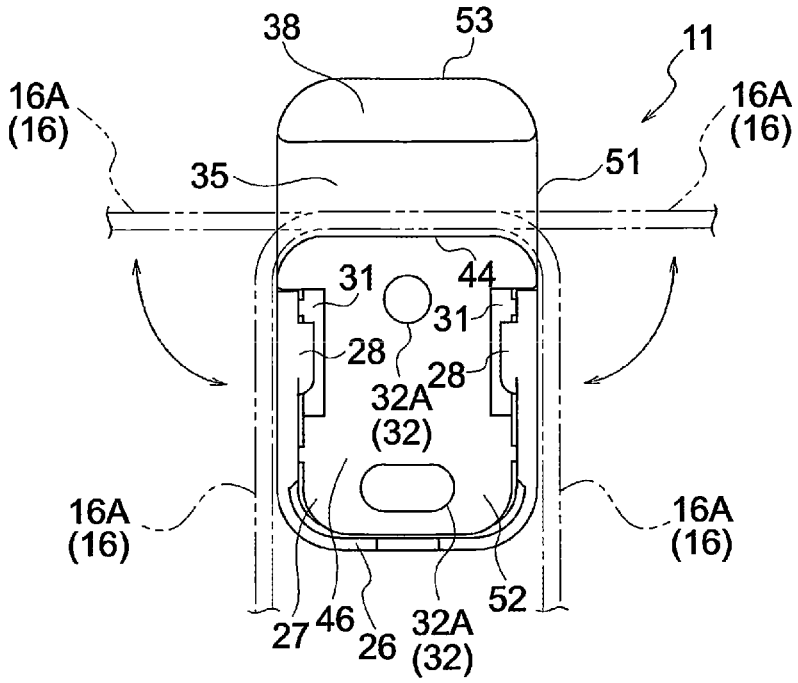
FIG. 14 is a rear view of the second receiving member of FIG. 13 as seen from the rear.
Figure 15:
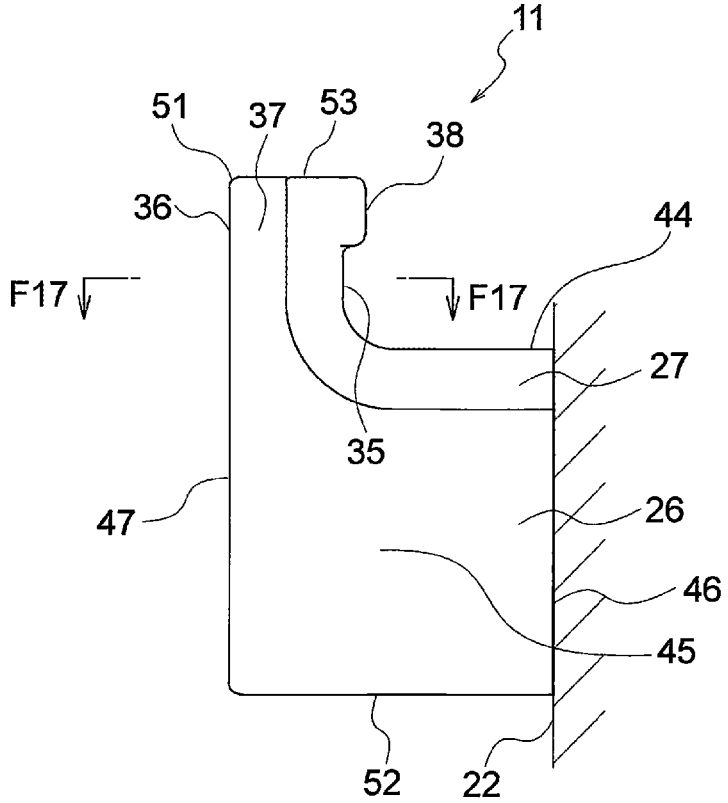
FIG. 15 is a side view of the second receiving member of FIG. 13 as seen from the side.

As shown in FIG. 15, the second hook portion 53 projects from the vicinity of a second outer surface 47 of the second receiving member main body 52 in the direction along the second wall surface 22 to which the second receiving member 51 is fixed (for example, upward). As shown in FIG. 13 to FIG. 17, the second hook portion 53 includes: an inner surface 35; a flat first outer surface 36 provided on the opposite side of the inner surface 35; a pair of first flat surfaces 37 provided on both sides sandwiching the inner surface 35; and a protruding portion 38 protruding closer to the second wall surface 22 than the inner surface 35.

As shown in FIG. 17, the first outer surface 36 extends along the second wall surface 22. The inner surface 35 has an arc cross section. The first flat surface 37 extends in the direction intersecting with the second wall surface 22 to which the second receiving member 51 is fixed. The protruding portion 38 is provided at the tip of the second hook portion 53 and is provided so as to rise from the inner surface 35. The protruding portion 38 functions as a so-called barb, and can prevent the rope 16 hooked on the inner surface 35 from falling off from the second hook portion 53.

As shown in FIG. 14, the second receiving member main body 52 has: a top surface 44 provided on the second hook portion 53 side; a pair of second flat surfaces 45 provided on both sides sandwiching the top surface 44; a fixed surface 46 fixed to the second wall surface 22; and a flat second outer surface 47 adjacent to the pair of second flat surfaces 45. The top surface 44 has an arc cross section. In the present embodiment, the top surface 44 has a flat surface in the middle (intermediate position) of the arc cross section. The second flat surface 45 is formed flush with the first flat surface 37. The second outer surface 47 is formed flush with the first outer surface 36.

Subsequently, the usage and action of the main body 12, the first receiving member 21 and the second receiving member 51 of the clothing drying device 11 of the present embodiment will be described.

FIG. 18 shows an aspect of the arrangement of the main body 12, the first receiving member 21 and the second receiving member 51 of the clothing drying device 11. As shown in FIG. 18, in the present aspect, the user, for example, fixes the main body 12 of the clothing drying device 11 to the first wall surface 13, and fixes the second receiving members 51 of the clothing drying device 11 to two places on the second wall surface 22 facing the first wall surface 13. The second receiving members 51 on the second wall surface 22 are installed with a gap between them in the lateral direction. Further, the user, for example, fixes the first receiving member 21 at the position which is laterally displaced from the main body 12, on the first wall surface 13.

The user can pull out the rope 16 from the main body 12, hook the rope main body 16A on the inner surface 35 of the second hook portion 53 of one of the second receiving members 51, and hook the rope main body 16A on the inner surface 35 of the second hook portion 53 of the other second receiving member 51. At this time, since the inner surfaces 35 of the second hook portions 53 have an arc cross section, the rope main body 16A can be guided by gentle curves. In addition, after the rope main body 16A is turned back with the two second receiving members 51 in this way, the user can pass the rope main body 16A through the groove portion 34 of the first receiving member 21, and hold a head portion 16BA of the grip portion 16B with a concave portion 41. As a result, the grip portion 16B of the rope 16 is fixed to the first receiving member 21, and the rope main body 16A is stretched in pairs between the first wall surface 13 and the second wall surface 22. At this time, torque is applied to the drum 15 of the main body 12 in the direction of winding the rope main body 16A by the action of the spiral spring, and a constant tension is applied to the rope main body 16A.

At this time, there is a difference in the installation height between the first receiving member 21 and the second receiving member 51, and even if the first receiving member 21 is installed at the position higher than the second receiving member 51, the rope main body 16A is gently bent and guided by the groove bottom portion 43 having an arc surface of the first receiving member 21. Therefore, it is prevented that the rope main body 16A is sharply bent at the position of the groove portion 34. Similarly, there is a difference in the installation height between the main body 12 and the second receiving member 51, and even if the second receiving member 51 is installed at the position higher than the main body 12, the rope main body 16A is gently bent and guided by the top surface 44 having an arc cross section of the second receiving member 51. Therefore, it is prevented that the rope main body 16A is sharply bent at the position of the top surface 44.

Further, even if the installation positions of the first receiving member 21 and the second receiving member 51 are laterally displaced, the rope main body 16A is gently bent and guided by the arc surface of the pole portions 42 of the groove portion 34 of the first receiving member 21. Therefore, it is prevented that the rope main body 16A is sharply bent at the position of the groove portion 34. Similarly, even if the installation positions of the main body 12 and the second receiving member 51 are laterally displaced, the rope main body 16A is gently bent and guided by the inner surface 35 having an arc cross section of the second hook portion 53 of the second receiving member 51. Therefore, it is prevented that the rope main body 16A is sharply bent at the position of the inner surface 35.

The user can hook the laundry on the rope 16 stretched in this way and dry the laundry indoors.

(The First Modification)

Figure 19:
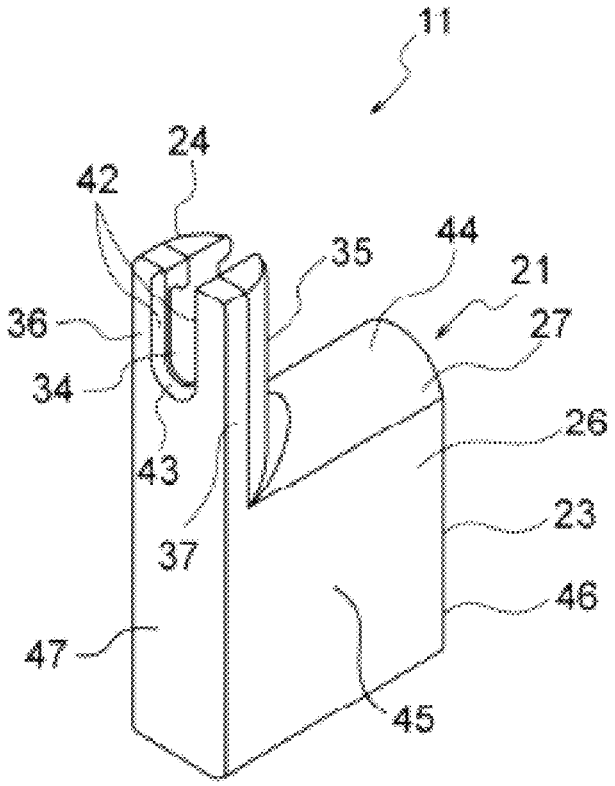
FIG. 19 is a perspective view of a first receiving member of a clothing drying device of a first modification example as seen from the front.
Figure 20:
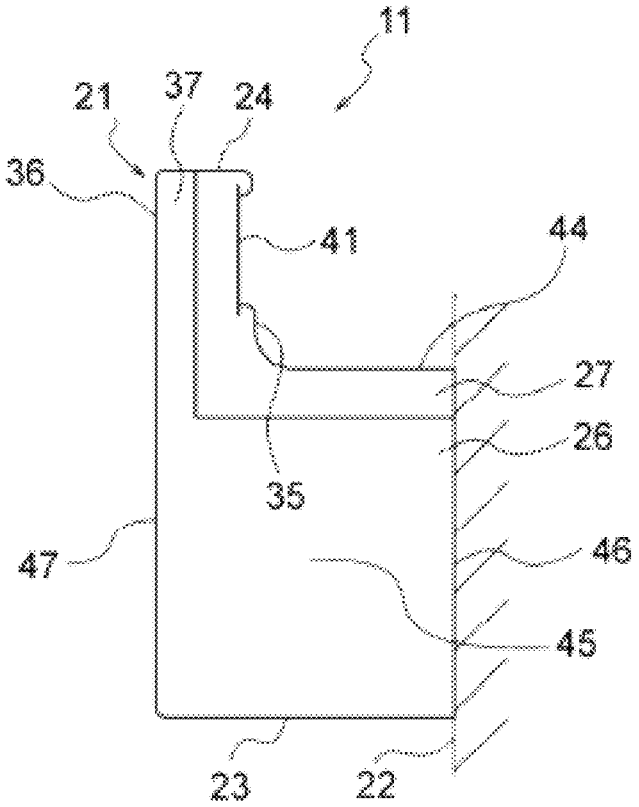
FIG. 20 is a side view of the first receiving member of FIG. 19 as seen from the side.

Subsequently, with reference to FIG. 19 and FIG. 20, a modification of the first receiving member 21 of the clothing drying device 11 of the above embodiment will be described.

A first receiving member 21 of the present modification is formed to be narrower than the first receiving member 21 of the first embodiment. Therefore, in the present embodiment, a top surface 44 of a first receiving member main body 23 has an arc cross section, but does not have a flat surface in the middle (intermediate position) of the arc cross section. Further, it does not have a protruding portion 38.

According to the present modification, although the first receiving member 21 is formed to be narrower than that of the first embodiment, the action and effect is substantially the same as those of the first receiving member 21 of the first embodiment.

(The Second Modification)

Figure 21:
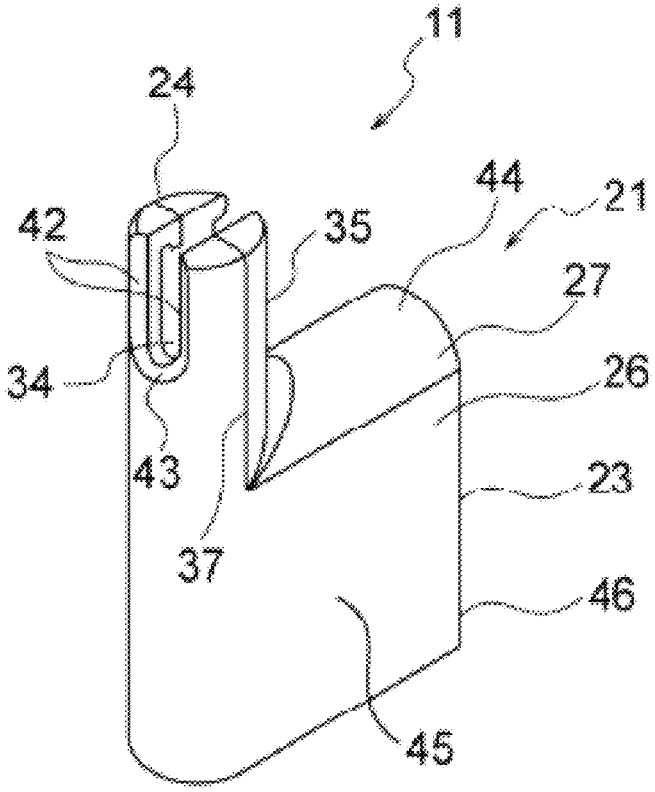
FIG. 21 is a perspective view of a first receiving member of a clothing drying device of a second modification example as seen from the front.
Figure 22:
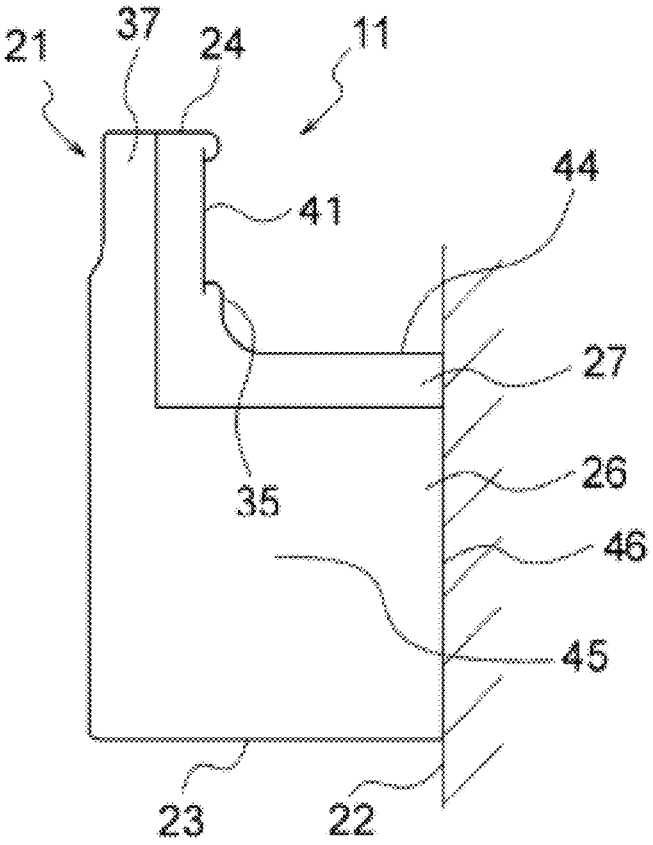
FIG. 22 is a side view of the first receiving member of FIG. 21 as seen from the side.

Subsequently, with reference to FIG. 21 and FIG. 22, a modification of the first receiving member 21 of the clothing drying device 11 of the above embodiment will be described.

In a first receiving member 21 of the present modification, a first hook portion 24 has a round bar shape. The first hook portion 24 extends along a wall surface (the second wall surface 22) to which the first receiving member 21 is fixed. Therefore, the first receiving member 21 does not have a flat first outer surface 36 and a second outer surface 47.

The first receiving member 21 of the present modification is formed to be narrower than the first receiving member 21 of the first embodiment. Therefore, in the present embodiment, a top surface 44 of a first receiving member main body 23 has an arc cross section, but does not have a flat surface in the middle (intermediate position) of the arc cross section. Further, it does not have a protruding portion 38.

According to the present modification, although the first receiving member 21 is formed to be narrower than that of the first embodiment, the action and effect is substantially the same as those of the first receiving member 21 of the first embodiment.

According to the present modification, the followings can be said. The clothing drying device 11 includes: a rope 16 having a rope main body 16A and a grip portion 16B provided at the tip of the rope main body 16A; a main body 12 storing the rope 16 so that the rope 16 can be polled out to the outside; and a receiving member provided independently of the main body 12 and having a receiving member main body and a hook portion protruding from the receiving member main body, the hook portion has a round bar shape extending along the wall surface the receiving member is fixed to, and the rope main body 16A can be hooked around the round bar, the receiving member main body has a top surface 44 provided on the hook portion side and having an arc cross section, and a pair of flat surfaces provided on both sides sandwiching the top surface 44, and the rope main body 16A can be hooked so as to straddle at least one of the pair of flat surfaces, and the top surface 44.

According to this configuration, since the hook portion and the top surface 44 each have an arc cross section, the rope main body 16A hooked on them can be guided by gentle curves. As a result, it is possible to prevent the rope main body 16A hooked on the hook portion or the top surface 44 from being sharply bent at these positions and being damaged at these positions.

In this case, the clothing drying device 11 has a width larger than the diameter of the rope main body 16A and smaller than the diameter of the grip portion 16B, and includes the groove portion 34 penetrating the hook portion in the direction intersecting with the wall surface to which the receiving member is fixed. According to this configuration, the rope 16 can be stretched between the main body 12 and the first receiving member 21 by hooking the grip portion 16B on the groove portion 34.

(The Third Modification)

Figure 23:
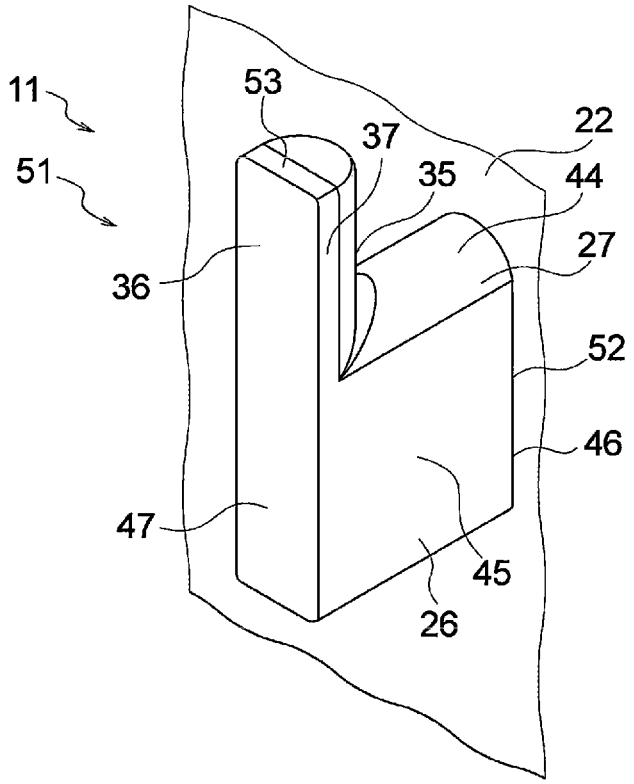
FIG. 23 is a perspective view of a second receiving member of a clothing drying device of a third modification example as seen from the front.

Subsequently, with reference to FIG. 23, a modification of the second receiving member 51 of the clothing drying device 11 of the above embodiment will be described.

A second receiving member 51 of the present modification is formed to be narrower than the second receiving member 51 of the second embodiment. Therefore, in the present embodiment, a top surface 44 of a second receiving member main body 52 has an arc cross section, but does not have a flat surface in the middle (intermediate position) of the arc cross section. Further, it does not have a protruding portion 38.

According to the present modification, although the second receiving member 51 is formed to be narrower than that of the second embodiment, the action and effect is substantially the same as those of the second receiving member 51 of the second embodiment.

(The Fourth Modification)

Figure 24:
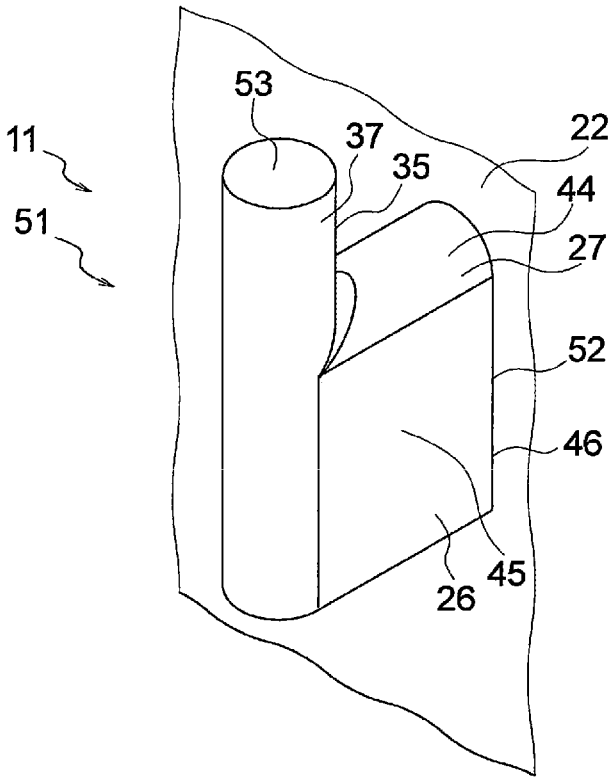
FIG. 24 is a perspective view of a second receiving member of a clothing drying device of a forth modification example as seen from the front.

Subsequently, with reference to FIG. 24, a modification of the second receiving member 51 of the clothing drying device 11 of the above embodiment will be described.

In a second receiving member 51 of the present modification, a second hook portion 53 has a round bar shape. The second hook portion 53 extends along a wall surface (a second wall surface 22) to which the second receiving member 51 is fixed. Therefore, the second receiving member 51 does not have a flat first outer surface 36 and a second outer surface 47.

The second receiving member 51 of the present modification is formed to be narrower than the second receiving member 51 of the second embodiment. Therefore, in the present embodiment, a top surface 44 of a second receiving member main body 52 has an arc cross section, but does not have a flat surface in the middle (intermediate position) of the arc cross section. Further, it does not have a protruding portion 38.

According to the present modification, although the second receiving member 51 is formed to be narrower than that of the second embodiment, the action and effect is substantially the same as those of the second receiving member 51 of the second embodiment.

The above-described embodiments can be implemented by adding various replacements and modifications.

REFERENCE SIGNS LIST

11 clothing drying device
12 wall surface
13 first wall surface
14 casing body
15 drum
16 rope
16A rope main body
16B grip portion
16BA head portion
17 outlet
18 disengaging portion
21 first receiving member
22 second wall surface
23 first receiving member main body
24 first hook portion
25 packing
26 first part
27 second part
28 claw portion
31 recessed portion
32 fixing portion
32A through hole
34 groove portion
35 inner surface
36 first outer surface
37 first flat surface
38 protruding portion
41 concave portion
42 pole portion
43 groove bottom portion
44 top surface
45 second flat surface
46 fixing surface
47 second outer surface
51 second receiving member
52 second receiving member main body
53 second hook portion

The invention claimed is:

1. A clothing drying device comprising:

a rope comprising a rope main body and a grip portion provided at the tip of the rope main body, a main body storing the rope, the rope being capable of pulling out to the outside, and a receiving member provided independently of the main body and comprising a receiving member main body and a hook portion protruding from the receiving member main body, the receiving member main body comprising a fixing surface to be fixed to a wall surface, wherein the hook portion comprises an inner surface facing the wall surface to which the fixing surface is fixed, the inner surface comprising an arc cross section and a pair of first flat surfaces provided on both sides of the hook portion sandwiching the inner surface, and the rope main body configured to be capable of hooking so as to straddle at least one of the pair of first flat surfaces, and the inner surface, wherein the receiving member main body comprises a top surface facing a direction in which the hook portion protrudes and comprising an arc cross section, and a pair of second flat surfaces provided on both sides of the receiving member main body sandwiching the top surface, and the rope main body configured to be capable of hooking so as to straddle at least one of the pair of second flat surfaces, and the top surface.

2. The clothing drying device according to claim 1, wherein the hook portion comprises a flat first outer surface adjacent to the pair of first flat surfaces, the receiving member main body comprises a flat second outer surface adjacent to the pair of second flat surfaces, and the first outer surface is flush with the second outer surface.

3. The clothing drying device according to claim 1, wherein the hook portion comprises a protruding portion protruding closer to a wall surface the receiving member is fixed to than the inner surface.

4. The clothing drying device according to claim 1 comprising a groove portion comprising a width larger than the diameter of the rope main body and smaller than the diameter of the grip portion and penetrating the hook portion in the direction intersecting with the wall surface to which the receiving member is fixed.

5. The clothing drying device according to claim 4, wherein the hook portion comprises a concave portion provided at the position adjacent to the groove portion of the inner surface and recessed in a shape complementary to a part of the grip portion.

6. The clothing drying device according to claim 4, wherein the inner diameter of the groove portion increases as the distance from the wall surface to which the receiving member is fixed increases.

7. The clothing drying device according to claim 6, wherein the hook portion comprises pole portions provided on both sides sandwiching the groove portion, and the cross-sectional shape of the surface defining the groove portion between the pole portions is an arc shape.

8. The clothing drying device according to claim 6, wherein the hook portion comprise a groove bottom portion defining the bottom of the groove portion, and the cross-sectional shape of the surface defining the groove portion of the groove bottom portion is an arc shape.

9. The clothing drying device according to claim 8, wherein the groove bottom portion is arched so as to be convex in the direction away from the central portion of the groove portion.

10. A clothing drying device comprising:

a rope comprising a rope main body and a grip portion provided at the tip of the rope main body, a main body storing the rope, the rope being capable of polling out to the outside, and a receiving member provided independently of the main body and comprising a receiving member main body and a hook portion protruding from the receiving member main body, wherein the hook portion comprises a round bar shape extending along the wall surface to which the receiving member is fixed, and the rope main body configured to be capable of hooking around the hook portion, the receiving member main body comprises a top surface provided on the hook portion side and comprising an arc cross section, and a pair of flat surfaces provided on both sides sandwiching the top surface, and the rope main body configured to be capable of hooking so as to straddle at least one of the pair of flat surfaces, and the top surface.

11. The clothing drying device according to claim 10 comprising a groove portion comprising a width larger than the diameter of the rope main body and smaller than the diameter of the grip portion and penetrating the hook portion in the direction intersecting with the wall surface to which the receiving member is fixed.

12. A clothing drying device comprising:

a rope comprising a rope main body and a grip portion provided at the tip of the rope main body, a main body storing the rope, the rope being capable of pulling out to the outside, and a receiving member provided independently of the main body and comprising a receiving member main body and a hook portion protruding from the receiving member main body, the receiving member main body comprising a fixing surface to be fixed to a wall surface, wherein the hook portion comprises an inner surface facing the wall surface to which the fixing surface is fixed, the inner surface comprising an arc cross section and a pair of first flat surfaces provided on both sides of the hook portion sandwiching the inner surface, and the rope main body configured to be capable of hooking so as to straddle at least one of the pair of first flat surfaces, and the inner surface, wherein the clothing drying device further comprises a groove portion comprising a width larger than the diameter of the rope main body and smaller than the diameter of the grip portion and penetrating the hook portion in the direction intersecting with the wall surface to which the receiving member is fixed.

13. The clothing drying device according to claim 12, wherein the hook portion comprises a protruding portion protruding closer to a wall surface the receiving member is fixed to than the inner surface.

* * * * *